US005820935A

United States Patent [19]

Kashiwabara et al.

[11] Patent Number: 5,820,935

[45] Date of Patent: Oct. 13, 1998

[54] COATING METHOD AND COATING APPARATUS INCLUDING UNIFORMLY FLOATING ROTATING MEMBER IN FLUID RESERVOIR

[75] Inventors: Yutaka Kashiwabara; Shuichi Endo; Kazuhiko Nojo, all of Shizuoka; Toshiharu Kubota, Kanagawa; Kazuo Ozaki, Shizuoka, all of Japan

[73] Assignee: Fuji Photo Film Co., Ltd., Kanagawa, Japan

[21] Appl. No.: 733,112

[22] Filed: Oct. 16, 1996

[30] Foreign Application Priority Data

Oct. 16, 1995 [JP] Japan ..... 7-267336
Jul. 11, 1996 [JP] Japan ..... 8-182133

[51] Int. Cl.[6] ..... B05D 3/12

[52] U.S. Cl. ..... 427/359; 427/428; 118/110; 118/125; 118/244; 118/410; 118/411; 118/414

[58] Field of Search ..... 427/428, 359; 118/110, 118, 119, 125, 244, 410, 411, 414

[56] References Cited

U.S. PATENT DOCUMENTS 4,263,870 4/1981 Saito et al. ..... 118/259
4,518,637 5/1985 Takeda et al. ..... 118/118

FOREIGN PATENT DOCUMENTS 0 213 323 3/1987 European Pat. Off. .

*Primary Examiner*—Katherine A. Bareford
*Attorney, Agent, or Firm*—Sughrue, Mion, Zinn, Macpeak & Seas, PLLC

[57] ABSTRACT

In a coating method and apparatus for applying coating liquid onto a web, the coating apparatus includes a rotating member rotatable and contacting with the web; and a support member supporting rotatably the rotating member and including a liquid reservoir formed between the rotating member and the support member, a fluid supply pipe, a cavity filled with the coating liquid and connecting to the fluid supply pipe, and a slit communicating the cavity with the liquid reservoir. The rotating member is supported by a fluid pressure of the liquid reservoir and the coating liquid supplied from the liquid reservoir forms a bead of the coating liquid by the rotating member between the web and the rotating member. The rotating member is floated uniformly in the widthwise direction by the fluid pressure so as to keep a predetermined clearance away from the support member to provide a stable coating. The bead is made uniform in the widthwise direction under any conditions.

14 Claims, 4 Drawing Sheets

COATING METHOD AND COATING APPARATUS INCLUDING UNIFORMLY FLOATING ROTATING MEMBER IN FLUID RESERVOIR

BACKGROUND OF THE INVENTION

The present invention relates to a method of applying coating liquid onto a continuously running belt-like support (hereinafter referred to as a web) and an apparatus therefor, and particularly relates to improvements of a bar or roller coating method and an apparatus therefor.

In conventional bar coating methods, U.S. Pat. No. 4,263,870 which corresponds to Examined Japanese Patent Publication No. 58-4589 discloses a coating method in which coating liquid is supplied so that a liquid reservoir is formed at a position immediately before a contacting position between a web and a bar supported by a support member so as to rotate while contacting with the web at a linear speed not lower than 4 m/min in the same direction as that of the web, and the coating liquid is applied onto the web by the bar. FIG. 8 shows an embodiment of the conventional bar coating apparatus.

In FIG. 8, the apparatus is characterized in that a coating rod (bar) 2 is supported by a bar support member 4 while contacting with a web 1, coating liquid 3 is supplied so as to form a liquid reservoir and a bead 6 on the web 1, and the coating liquid 3 is applied onto the web 1 by using the coating rod 2.

As an improved coating apparatus in which coating is performed in the state where an object to be coated is floated by coating fluid, Examined Japanese Patent Publication No. 57-55468 discloses a coating apparatus characterized in that a coating apparatus body having an exhaust nozzle for ejecting coating fluid and having a coating roller provided at the exhaust nozzle is supported in the vicinity of a strip so that coating is performed onto the strip while the strip is supported in the floated state by the fluid ejected from the exhaust nozzle through the coating roller. This coating apparatus in which coating is performed in the state of floating an object to be coated on coating fluid is characterized in that, as shown in FIG. 7, a coating apparatus body 9 having an exhaust nozzle 7 for ejecting coating fluid and having a coating roller 8 provided at the exhaust nozzle 7 is supported in the vicinity of a strip 10 so that coating is performed onto the strip 10 while the strip is supported in the floated state by the fluid ejected from the exhaust nozzle 7 through the coating roller 8.

In the bar or roller coating method, however, an excessive amount of fluid is transferred onto a web and an excessive portion is scratched by using a bar standing still or rotating at a predetermined peripheral speed in the forward or reverse direction relative to the web so that a desired amount of coating is obtained.

In the coating method of FIG. 8, the bar or roller 2 and the bar support member 4 may come into contact with each other to thereby be partially injury so that the injure may disturb the uniformly coated surface. On the other hand, in the case of a dispersed fluid, a cohesion matter is generated by the shearing force between the bar or the roller and the support member to disturb the uniformly coated surface. Further, as a countermeasure, it is considered that the bar or roller is floated from the bar support member. As illustrated in FIG. 7 according to the Examined Japanese Patent Publication No. 57-55468, the coating roller 8 is floated and a high viscosity fluid such as rolling oil, rust preventing oil or the like is applied onto the strip 10. In the case where this method is applied to a generally-used coating method, however, a distribution is generated in the amount of supplied fluid in the widthwise direction because the fluid is low in viscosity so that the coating roller 8 is not uniformly floated. As a result, when the foregoing method is applied to the case where a small amount of fluid having relatively low viscosity is applied onto a web such as paper, a plastic sheet or the like, in which strict accuracy is required, there is generated such a problem that the coating roller partially comes into contact with the coating apparatus body 9 so that the coating roller 8 and the coating apparatus body 9 are worn or disturbance of the coated surface state is generated due to generation of the cohesion matter.

SUMMARY OF THE INVENTION

An object of the present invention is to solve the conventional problems and another object of the present invention is to provide a stable coating method and apparatus therefor, in which a bar or roller is floated uniformly in the widthwise direction by the fluid pressure so as to keep a predetermined clearance from a support member, so that the amount of fluid between the bar or roller and the support member is made uniform in the widthwise direction even under the conditions in which the bar or roller is rotated at a high speed, the fluid viscosity is increased in the low viscosity region, or the amount of supplied fluid is reduced, thereby making a bead formed between the bar or roller and a web uniform in the widthwise direction so that the bar or roller and the support member thereof are hardly worn or no disturbance is generated in the coated surface by the generation of a cohesion matter.

The above objects of the present invention are achieved by the following method and apparatus.

(1) A bar or roller coating method in which coating liquid is applied onto a web through a liquid reservoir and a bead by using a bar or roller which is supported on a support member directly or through a fluid and which is rotating while contacting with the web, characterized in that the support member has a cavity to be filled with the coating liquid succeeding to a fluid supply pipe, the cavity communicating with the liquid reservoir through a slit, and that the bar or roller is supported by fluid pressure of the liquid reservoir and the coating liquid is supplied to the bead by the bar or roller.

(2) A bar or roller coating method in which coating liquid is applied onto a web through a liquid reservoir and a bead by using a bar or roller which is supported on a support member directly or through a fluid and which is rotating while contacting with the web, characterized in that the support member has a cavity to be filled with the coating liquid succeeding to a fluid supply pipe, the cavity communicating with the liquid reservoir through a slit, that the bar or roller is supported by fluid pressure of the liquid reservoir and the coating liquid is supplied to the bead by the bar or roller, and that further expanded second liquid reservoir portions are provided in portions upper than portions of the first-mentioned liquid reservoir where gaps between the bar or roller and the support member are made narrower and in upstream and downstream sides of the support member in a running direction of the web.

(3) A bar or roller coating apparatus in which coating liquid is applied onto a web through a liquid reservoir and a bead by using a bar or roller which is supported on a support member directly or through a fluid and which is rotating while contacting with the web, characterized in that the support member includes a cavity to be filled with the coating liquid succeeding to a fluid supply pipe, and a slit which makes the cavity and the liquid reservoir communicate with each other, and that the bar or roller is supported by fluid pressure of the liquid reservoir and the coating liquid is supplied to the bead by using the bar or roller.

(4) A bar or roller coating apparatus in which coating liquid is applied onto a web through a liquid reservoir and a bead by using a bar or roller which is supported on a support member directly or through a fluid and which is rotating while contacting with the web, characterized in that the support member includes a cavity to be filled with the coating liquid succeeding to a fluid supply pipe, and a slit which makes the cavity and the liquid reservoir communicate with each other, and that the bar or roller is supported by fluid pressure of the liquid reservoir and the coating liquid is supplied to the bead by using the bar or roller, and that further expanded second liquid reservoir portions are provided in portions upper than portions of the first-mentioned liquid reservoir where gaps between the bar or roller and the support member are made narrower and in upstream and downstream sides of the support member in a running direction of the web.

(5) A coating apparatus according to the above item (4) characterized in that at least one supply port for supplying the further expanded second liquid reservoir portions with the coating liquid is provided in damming walls in portions upper than the portions where the gaps between the bar or roller and the support member are made narrower.

It is preferable that the bar or roller has a diameter in a range of 2 to 200 mm. Further, it is preferable that the slits are provided by two or more in number in symmetrical positions with respect to the bar or roller.

Features of the present invention include the support member configured so as to communicate with the liquid reservoir through the fluid supply pipe, the cavity, and the slit so that the roller is supported by the fluid pressure and the coating liquid is supplied to the bead.

That is, the fluid supply pipe is used for supplying the coating liquid from a tank to the support member. Although only one fluid supply pipe is originally used, a plurality of fluid supply pipes may be used.

Further, the so-called cavity has a function for receiving the coating liquid from the supply pipe and for converting the dynamic pressure of the coating liquid in the pipe into static pressure by the whole coating width and the space so as to make uniform the pressure in the cavity. Therefore, it is desirable that the size of the supply pipe is selected to be enough to convert the dynamic pressure into static one. Specifically, it is desirable that the diameter of the cavity is selected to be 2 to 4 times as large as the supply pipe diameter D.

Moreover, the slit makes the coating liquid distribute uniformly in the widthwise direction of coating and supports the roller uniformly all over the width of the roller so that the static pressure in the cavity is further converted into the whole pressure including the dynamic pressure. It is preferable to select the width of the slit to be in a range of 0.2 mm to 0.7 mm.

Furthermore, it is preferable to make the shape of the liquid reservoir concentrical with the bar or roller so that the liquid reservoir supports the bar or roller, and it is desirable that not only the coating liquid fed from the slit supports the bar or roller on one line where the slit contacts with the bar or roller but also the whole fluid in the liquid reservoir supports the bar or roller uniformly. The structure of the support member includes the fluid supply pipe, the cavity to be filled with the fluid, the slit, and the liquid reservoir supports the bar or roller uniformly all over the coating width. The structure is required in the case of treating coating liquid having relatively low viscosity. The coating liquid supplied uniformly in the widthwise direction is supplied into the liquid reservoir so that the bead formed by the rotating of the roller and the running of the web is made to be further uniform in the widthwise direction. Accordingly, it is possible to obtain an excellent coating quality.

The diameter of the bar or roller is selected to be within a range of 2 to 200 mm, preferably, 5 to 20 mm, although the diameter of the bar is different from the diameter of the roller.

Further, the number of slits is not limited to one and alternatively a plurality of slits may be used. In the case of using a plurality of slits, it is preferable that the slits are symmetrically provided with respect to the bar or roller.

For the bar, a rod with wire of a predetermined diameter tightly wound on its surface, a rod in which grooves having a predetermined width and depth are formed on its surface at predetermined pitches, or the like, is used. Ordinarily, the bar is used in a static state, in an intermittently rotating state, or in a rotating state in the direction reverse to the web at a peripheral speed lower than the web. Further, the amount of coating can be controlled easily and accurately by suitably selecting the wire diameter of the wire bar, the depth or pitch of the grooves of the grooved bar, or the like.

A feature of the present invention includes that the further expanded second liquid reservoir portions are provided in portions above the portion of the first-mentioned liquid reservoir where the clearance portion formed between the bar or roller and the support member is made narrower, so that the coating liquid is accumulated uniformly in the widthwise direction. This feature is used also when the bar or roller rotational speed is made relatively high, when the viscosity is increased, or when the amount of supplied fluid is reduced.

As the method of providing the second liquid reservoir portions, there have been proposed two methods of forming the second liquid reservoir portions in the top end of the support member and providing the damming members at the outside of the top end of the support member.

In the method of forming the second liquid reservoir portions in the top end of the support member, it is necessary to make the level of the fluid accumulated in the second liquid reservoir portions low so that the fluid does not directly come into contact with the running web even if the level of the fluid comes into contact with the bar or roller. In the case of using such a kind of coating composition that the state of the coated surface is not disturbed, however, the height of the support member top end at the upstream side of the web may be made so that the level of the fluid comes into contact with the web to form a bead between the web and the support member top end. Further, it is preferable to select the sectional area of each of the second liquid reservoir portions to be in a range of 0.01 to 100 $cm^2$, preferably, 0.1 to 20 $cm^2$.

In the method of providing the damming members at the outside of the top end of the support member, it is necessary that the height of the respective damming member is selected to be higher than that of the support member top end so that the level of the accumulated fluid does not come into contact with the running web even if the level of the fluid comes into contact with the bar or roller. In the case of using a kind of coating composition such that the state of the coated surface is not disturbed, however, the height of the damming member at the upstream side of the web may be made so that the level of the fluid comes into contact with the web to form the bead between the web and the damming member. Further, it is suitable to select the sectional area of each of second liquid reservoir portion to be in a range of 0.01 to 100 $cm^2$, preferably, 0.1 to 20 $cm^2$.

When the coating liquid supply port is provided in the second liquid reservoir portion so as to supply the coating liquid, the supply port is provided from one side or both sides in the widthwise direction and the fluid supply port is provided in the widthwise direction so that the fluid flows in the widthwise direction. Further, the supply port may be provided on the top end of the support member or damming member in one or more places in the widthwise direction. Furthermore, depending on the amount of fluid supply, the bead formed between the bar or roller and the web is disturbed in accordance with the flow state of the overflowed fluid and therefore it is necessary to control the amount of fluid supply. Then, when the fluid supply system is branched from the pipe arrangement for supplying the fluid to the bar or roller coating apparatus, a ball valve or the like is provided in the supply pipe arrangement so as to control the amount of fluid by adjustment of the opening of the valve, or the like. Furthermore, the supply pipe may be used as an independent fluid supply system so that the amount of fluid supply is controlled by controlling a pump. It is preferable to select the amount of fluid supply to be in a range of 0.01 to 1.0 cc/s/cm, preferably, 0.01 to 0.2 cc/s/cm.

DETAILED DESCRIPTION OF THE PREFERRED EMBODIMENTS

Embodiments of the present invention will be described by using the accompanied drawings.

Figure 1:
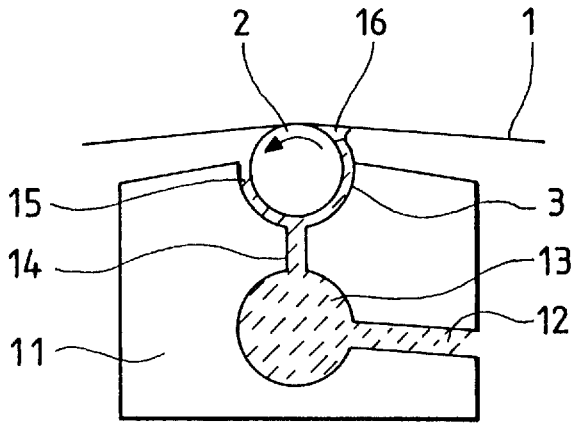
FIG. 1 is a side view showing a first embodiment of the coating apparatus according to the present invention.

In a first embodiment according to the present invention as shown in FIG. 1, a coating rod (bar) 2 supported by a bar support member 11 performs coating while contacting with a continuously running web 1.

The bar or roller coating apparatus is characterized in that a support member 11 is supplied with coating liquid 3 from a supply port communicating with coating liquid supply pipe 12, the support member 11 has a cylindrical cavity 13 to be filled with the fluid supplied through the fluid supply pipe 12, the cavity 13 communicates with a liquid reservoir 15 through a slit 14, the bar or roller 2 is supported by the fluid pressure in the liquid reservoir 15, so that the coating liquid is supplied to a bead 16 by the bar or roller 2.

Figure 2C:
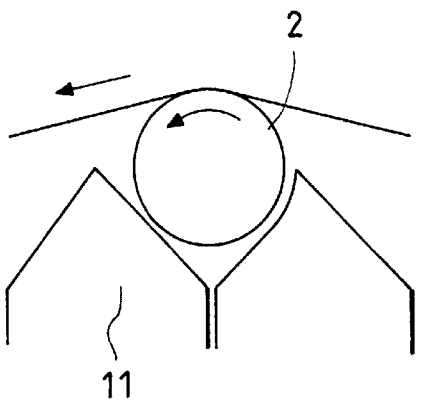
FIGS. 2A, 2B, and 2C are partially enlarged views showing various top end shapes of a support member in the coating apparatus according to the present invention.
Figure 2B:
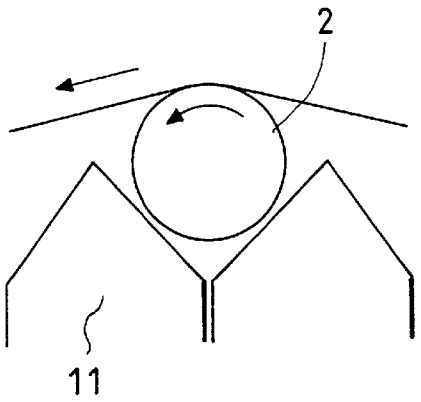
Figure 2A:
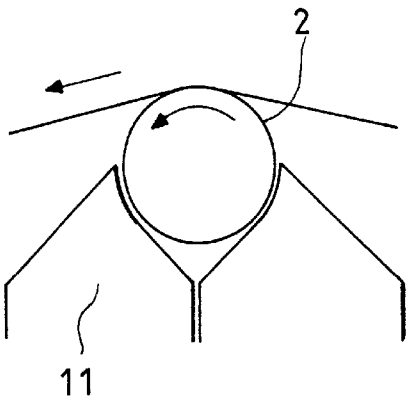

FIGS. 2A to 2C are partially enlarged views showing various shapes of the top end of the support member, in which FIG. 2A shows a shape of a concentric circle with respect to the outer circumference of the bar; FIG. 2B shows a shape of a tangent to the outer circumference of the bar; and FIG. 2C shows a shape in which a shape of a concentric circle is used at the upstream side and a shape of a tangent is used at the downstream side.

Figure 3:
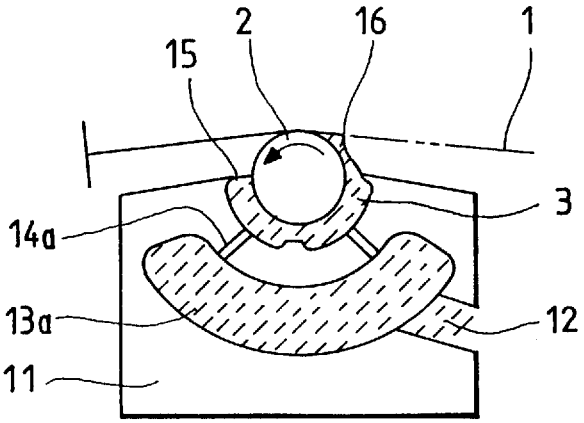
FIG. 3 is a side view showing a second embodiment of the coating apparatus according to the present invention.

FIG. 3 shows a second embodiment according to the present invention. This bar or roller coating apparatus is characterized in that a support member 11 is supplied with coating liquid 3 from a supply port communicating with coating liquid supply pipe 12, the support member 11 has an enlarged and modified cavity 13*a* following the fluid supply pipe 12 and a bar or roller 2 is supported by the fluid pressure in a liquid reservoir 15, so that the coating liquid 3 is supplied from the cavity 13*a* to a reservoir 15 via slits 14*a*, and to a bead 16 by the bar or roller 2.

Figure 4:
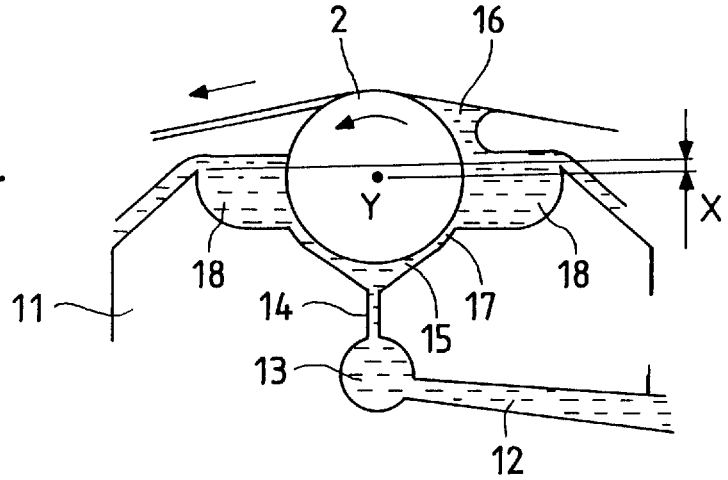
FIG. 4 is a side view showing a third embodiment of the coating apparatus according to the present invention.

FIG. 4 is a side view for explaining a third embodiment according to the present invention.

A support member 11 has a cavity 13 to be filled with a fluid supplied through a fluid supply pipe 12. The cavity 13 communicates with a liquid reservoir 15 through a slit 14. A bar or roller 2 is supported by the fluid pressure of the liquid reservoir 15. The coating liquid is supplied to a bead 16 by the bar or roller 2, so that the coating liquid is applied onto a web through the liquid reservoir 15 and the bead 16 by the bar or roller 2 which is rotating while contacting with the web. In this case, the bar or roller coating apparatus is characterized in that further expanded second liquid reservoir portions 18 are provided in portions above the portions of the liquid reservoir 15 where the clearance portion 17 formed between the bar or roller 2 and the support member 11 is narrowed such that the second liquid reservoir portions are positioned on up- and downstream sides in the running direction of the web. Accordingly, the spaces between the bar or roller 2 and the support member 11 are always filled with the coating liquid so as to stabilize the bead 16 formed between the bar or roller and the web.

Figure 5:
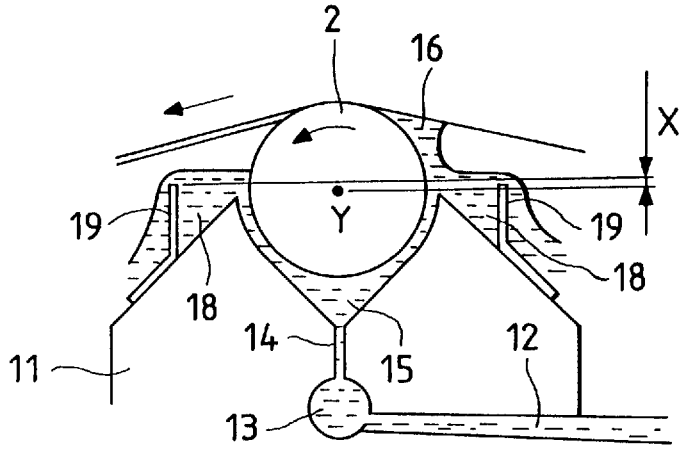
FIG. 5 is a side view showing a fourth embodiment of the coating apparatus according to the present invention.

FIG. 5 shows a fourth embodiment according to the present invention. In this bar or roller coating apparatus, a support member 11 has a cavity 13 to be filled with a fluid supplied through a fluid supply pipe 12. The cavity 13 communicates with a liquid reservoir 15 through a slit 14. A bar or roller 2 is supported by the fluid pressure of the liquid reservoir 15. The coating liquid is supplied to a bead 16 by the bar or roller 2 so that the coating liquid is applied onto a web through the liquid reservoir 15 and the bead 16 by the bar or roller 2 which is rotating while contacting with the web. Damming members 19 are provided in the outside of the top end of the support member on the up- and downstream sides in the running direction of the web so that the spaces between the bar or roller and the support member are always filled with the coating liquid to stabilize the bead 16 formed between the bar or roller and the web.

Figure 6:
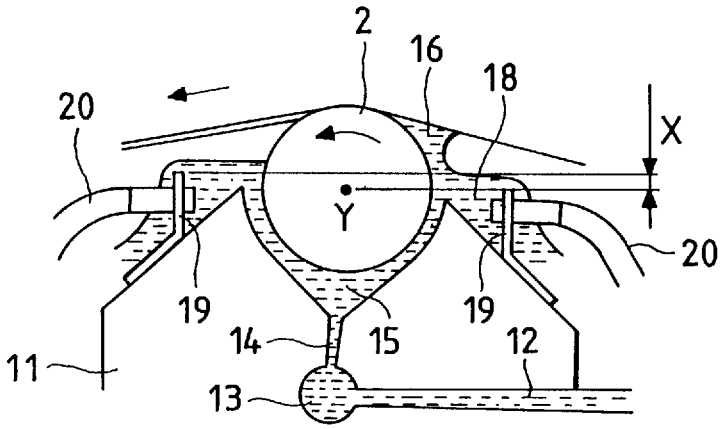
FIG. 6 is a side view showing a fifth embodiment of the coating apparatus according to the present invention.
Figure 7:
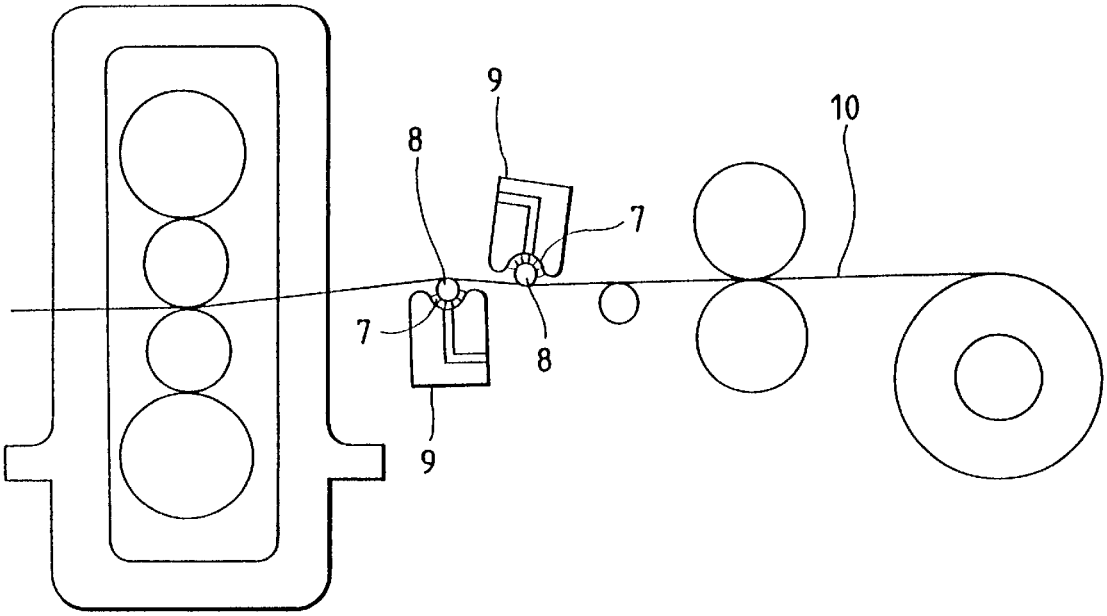
FIG. 7 PRIOR ART
FIG. 7 is a schematic view showing the conventional apparatus in which coating is performed in the state where an object to be coated is floated by coating fluid.
Figure 8:
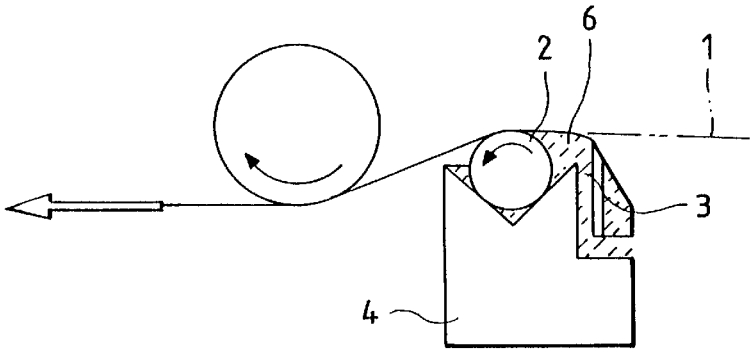
FIG. 8 PRIOR ART
FIG. 8 is a side view showing an example of the conventional bar coating apparatus.

FIG. 6 shows a fifth embodiment according to the present invention. In this bar or roller coating apparatus, a support member 11 has a cavity 13 to be filled with a fluid supplied through a fluid supply pipe 12. Coating liquid is supplied to a bead 16 by a bar or roller 2 so that the coating liquid is applied onto a web through a liquid reservoir 15 and the bead 16 by the bar or roller 2 which is rotating while contacting with the web. Further, expanded second liquid reservoir portions 18 are formed by damming members 19 on the up- and downstream sides in the running direction of the web. Fluid supply ports 20 are provided to supply the further expanded second liquid reservoir portions 18 with the coating liquid. Accordingly, the spaces between the bar or roller and the support member are always filled with the coating liquid so as to stabilize the bead 16 formed between the bar or roller and the web.

The present invention will be further described. The coating liquid to be used in the present invention is not specifically limited, and an aqueous solution or organic solvent fluid of a high molecular compound, a pigment water dispersion fluid, a colloid solution, or the like, may be utilized. Further, although the physical property of the coating liquid is not specifically limited, it is suitable to use coating liquid having low viscosity of not more than 100 cp, preferably, not more than 50 cp. Moreover, although the surface tension is not specifically limited, a particularly preferable effect can be obtained when the tension is not larger than 50 dyne/cm.

Further, the web to be used in the present invention includes paper, plastic film, resin coated paper, synthetic paper, and the like. The plastic film is made of a material selected from, for example, polyolefin such as polyethylene and polypropylene; a vinyl polymer such as polyvinyl acetate, polyvinyl chloride, and polystyrene; polyamide such as 6, 6-nylon and 6-nylon; polyester such as polyethylene terephtalate, and polyethylene-2,6-naphthalate; cellulose acetate such as polycarbonate, cellulose triacetate, and cellulose diacetate. Moreover, as the resin to be used for the resin-coated paper, polyolefin such as polyethylene is representative but the resin is not specifically limited to this.

Although also the thickness of the web is not specifically limited, a web having thickness in a range of about 0.01 mm to 1.0 mm is advantageous in view of treatment and general-purpose properties.

The bar to be used in the present invention includes a wired bar and a grooved bar.

In the case of using a wired bar in the present invention, it is suitable to select the diameter of the bar to be in a range of 5 mm to 20 mm, more preferably 6 mm to 15 mm. It is not preferable to make the diameter of the bar larger than the value in the foregoing range because a vertical crack is apt to be generated in a coating film. When the diameter of the bar is smaller than the value in the foregoing range, on the contrary, difficulty is generated in production. It is suitable to select the diameter of the wire to be in a range of 0.07 to 1.0 mm, preferably, 0.07 to 0.4 mm. When the diameter of the wire is larger than this value, the amount of coating is excessively increased so that the wire is not suitable for use in the bar coating method which is effective in high-speed thin-layer coating. When the diameter of the wire is smaller than the foregoing value, on the contrary, not only it is difficult to wind the wire so as to produce a wired bar, but also a problem is caused in strength. As the material of the wire, metal is used and stainless steel is the most suitable in view of the corrosion resistance, the abrasion resistance, the strength, and the like. The surface of the wire may be metal-plated for the purpose of further improving the abrasion resistance of the wire. Particularly, hard chromium plating is suitable.

Further, in the case of using a grooved bar in the present invention, it is suitable that the pitch of the grooves is selected to be in a range of 0.1 to 0.5 mm, preferably, 0.2 to 0.3 mm, and it is extremely suitable that the sectional shape is selected to be an approximately sine curve. The sectional shape is not always limited to the foregoing one, and a grooved bar having another sectional shape may be used. Generally, there is a predetermined relation of correspondence between grooved and wired bars, and it is considered that when the area per unit length of the space below the line connecting the tops of convex portions in the section, the wired and grooved bars are suitably used for coating with the same amount under the same condition. Therefore, a suitable grooved bar can be selected on the basis of the foregoing relation of correspondence and from the knowledge of the wired bar.

As the material of the bar, it is preferable to use metal in view of the corrosion resistance and the strength, and it is particularly suitable to use stainless steel.

As the material of the grooved bar, it is suitable to use metal, particularly, stainless steel, in view of the corrosion resistance, the strength, and the abrasion resistance.

As the bar support member, it is necessary to select the material having small frictional resistance against the bar (against wire in the case of a wired bar) because the bar rotates at a high speed. As the material of the bar support member to be preferably used in the present invention, for example, fluororesin, polyacetal resin, polyethylene resin, and polystyrene resin may be used. Among them, polytetrafluoroethylene which is known in the name of "Teflon" (the trade name of Du Pont (E.I.) de Nemours & CO. in the U.S.A.) and polyacetal resin which is known in the name of "Delrin" (the trade name of Du Pont (E.I.) de Nemours & CO. in the U.S.A.) are particularly preferable in view of the coefficient of friction and the strength. Further, it is possible to use the material in which a filler such as glass fiber, graphite, molybdenum disulfide, or the like, is added to the foregoing plastic material. Moreover, after the bar support member is produced from the metal material, the surface may be coated with the plastic material described above or the plastic material may be stuck on the surface so that the coefficient of friction against the bar is reduced. Alternatively, the material in which various metal material impregnated with the foregoing plastic material, for example, aluminum impregnated with polytetrafluoroethylene, may be used for the bar support member.

According to the present invention, the suitable size of the liquid reservoir and bead may vary in accordance with various conditions, specifically, in accordance with the physical properties such as the viscosity of the coating liquid, the structure and rotational speed of the bar, the running speed of the web, and so on. Therefore, it does not have so important meaning to prescribe the size of the liquid reservoir but it is rather realistic to investigate the manner how to select the parameters which can be controlled.

The manner how to select the conditions must be determined finally on the bases of experiences because the plural parameters are complicatedly related to one another. Generally speaking, it is confirmed that the ratio between the rotational peripheral speed Vb of the bar and the running speed Vw of the web has a limit and the minimum value of the ratio Vb/Vw which brings an excellent effect becomes smaller as the viscosity of the coating liquid increases, as the diameter (in the case of the grooved bar, the pitch or depth, or width of the grooves corresponding to the diameter) of the wire decreases, and as the coating speed, that is, the running speed Vw of the web increases. When the speed Vb excessively increases, however, the bar is apt to be worn and air is apt to be dragged. Accordingly, it is desirable to reduce the speed Vb to be as low as possible. Moreover, in the coating in the field of, for example, a photosensitive materials, or the like, where scratches cause a particularly important problem, it is desirable to set the condition that there is no relative speed between the bar and the web, that is, to set the condition so that the ratio of Vb/Vw is substantially equal to 1 (one).

EXAMPLE 1

The support member 11 formed by the liquid reservoir 15, the slit 14 positioned just below the bar 2, and the cavity 13 as shown in FIG. 1 was used, and a high molecule aqueous solution, a solid particle dispersed fluid, and an emulsion fluid each having viscosity in a range of 1 to 50 cp, were supplied, under the conditions that the bar diameter was 12 mm, the web tension was in a range of 0 to 2 kg/cm, and the web lap angle was in a range of 0° to 45° so as to obtain the flow rate of 1.00 cc/s/cm. Then, the bar 2 was floated uniformly in the widthwise direction by 30 μm or more with use of any support member. Further, although the rotational peripheral speed of the bar 2 was selected to be in a range of 0 to 200 m/min, the amount of floating was constant at any peripheral speed, and the accuracy of widthwise distribution of the amount of floating was not larger than 2 μm. In the foregoing conditions, the following effects could be confirmed.

(1) Although a scratch may be generated in the bar within 10 min. in general cases, no scratch was generated at all even in continuous running for 24 hours or more according to the present invention.

(2) Although a scratch may be generated in the support member within 10 min. in general cases, no scratch was generated at all even in continuous running for 24 hours or more according to the present invention.

(3) In the case of a solid particle dispersed fluid and emulsion, a cohesion matter was generated within 5 min. in the conventional coater. On the contrary, no cohesion matter was generated at all even in continuous running for 24 hours or more in this coater according to the present invention.

By the above finding, stable coating with no disturbance on the coated surface could be realized.

EXAMPLE 2

The support member 11 formed by the liquid reservoir 15, the slit 14 positioned just below the roll 2, and the cylindrical cavity 13 as shown in FIG. 1 was used, and a high molecule aqueous solution, a solid particle dispersed fluid, and an emulsion fluid each having viscosity in a range of 1 to 50 cp, were supplied, under the conditions that the roll diameter was 200 mm, the web tension was in a range of 0 to 2 kg/cm, and the web lap angle was in a range of 0° to 45° so as to obtain the flow rate of 2.5 cc/s/cm. Then, the roll 2 was floated uniformly in the widthwise direction by 20 μm or more with use of any support member. Further, although the rotational peripheral speed of the roll 2 was selected to be in a range of 0 to 200 m/min, the amount of floating was constant at any peripheral speed, and the accuracy of widthwise distribution of the amount of floating was not larger than 2 μm. In the foregoing conditions, the same effects as those in Example-1 could be confirmed.

EXAMPLE 3

The support member formed by the liquid reservoir 15, the slits 18 positioned in two places symmetrically with each other with respect to the obliquely downward bar of the bar 2, and the enlarged and modified cavity 13 as shown in FIG. 3 was used, and a high molecule aqueous solution, a solid particle dispersed fluid, and an emulsion fluid each having viscosity in a range of 1 to 50 cp, were supplied, under the conditions that the bar diameter was 20 mm, the web tension was in a range of 0 to 2 kg/cm, and the web lap angle was in a range of 0° to 45° so as to obtain the flow rate of 1.00 cc/s/cm. Then, the bar was floated uniformly in the widthwise direction by 30 μm or more. Further, although the rotational peripheral speed of the bar was selected to be in a range of 0 to 200 m/min, the amount of floating was constant at any peripheral speed, and the accuracy of widthwise distribution of the amount of floating was not larger than 2 μm. In the foregoing conditions, the same effects as those in Example-1 could be confirmed.

EXAMPLE 4

As shown in FIG. 4, the further expanded second liquid reservoir portions 18 were provided in the top end of the support member formed by the liquid reservoir 15, the slit 14 positioned just below the bar, and the cavity 13. The top end of the support member was made to be higher than the center Y of the bar 2 by a height X (1 mm in this example). The sectional area of the further expanded second liquid reservoir portion 18 was selected to be 3 $cm^2$. Other conditions were as follows. A high molecule aqueous solution, a solid particle dispersed fluid, and an emulsion fluid each having viscosity in a range of 1 to 50 cp, were supplied under the conditions that the bar diameter was 12 mm, the web tension was in a range of 0 to 2 kg/cm, and the web lap angle was in a range of 0° to 15° so as to obtain the flow rate of 1.0 cc/s/cm. The rotational peripheral speed of the bar 2 was selected to be in a range of 0 to 350 m/min.

Under the condition that the further expanded second liquid reservoir portions 18 were not provided, air was partially dragged, with the rotation of the bar, between the bar on the downstream side of the web and the support member, at the rotational peripheral speed of the bar of 250 m/min or more, so that the bead 16 formed between the bar and the web was disturbed to generate a stripe-shaped disturbance in the coated surface which should be uniform. According to the present invention in which the further expanded second liquid reservoir portions 18 were provided, however, the gap between the bar and the support member was filled with the fluid in the widthwise direction at any speed, so that no air was dragged, the bead formed between the bar and the web was stable, and an excellent coated surface was obtained.

EXAMPLE 5

As shown in FIG. 5, the damming member 19 was provided on the top end of the support member 11 formed by the liquid reservoir 15, the slit 14 positioned just below the bar, and the cavity 13. The height of the damming member was made to be higher than the center Y of the bar 2 by a height X (1 mm in this example). The sectional area of the further expanded second liquid reservoir portion 18 was selected to be 5 $cm^2$. Other conditions were as follows. A high molecule aqueous solution, a solid particle dispersed fluid, and an emulsion fluid each having viscosity in a range of 1 to 50 cp, were supplied under the conditions that the bar diameter was 20 mm, the web tension was in a range of 0 to 2 kg/cm, and the web lap angle was in a range of 0° to 15° so as to obtain the flow rate of 1.0 cc/s/cm. The rotational peripheral speed of the bar 2 was selected to be in a range of 0 to 350 m/min. Under the condition that the damming member 19 was not provided, air was partially dragged, with the rotation of the bar, between the bar on the downstream side of the web and the support member, at the rotational peripheral speed of the bar of 250 m/min or more, so that the bead 16 formed between the bar and the web was disturbed to generate a stripe-shaped disturbance in the coated surface which should be uniform. According to the present invention in which the damming member 19 was provided, however, the gap between the bar and the support member was filled with the fluid in the widthwise direction at any speed, so that no air was dragged, the bead 16 formed between the bar and the web was stable, and an excellent coated surface was obtained.

EXAMPLE 6

As shown in FIG. 6, the damming member 19 was provided on the top end of the support member 11 formed by the liquid reservoir 15, the slit 14 positioned just below the bar, and the cavity 13. The height of the damming member was made to be higher than the center Y of the bar 2 by a height X (1 mm in this example). The sectional area of the further expanded second liquid reservoir portion 18 was selected to be 5 $cm^2$. Further, the coating liquid supply ports 20 are provided on the widthwise opposite sides between the downstream side dam in the running direction of the web and the support member so that the coating liquid is supplied at flow rate of 0.1 cc/s/cm from each of the supply ports 20. Other conditions were as follows. A high molecule aqueous solution, a solid particle dispersed fluid, and an emulsion fluid each having viscosity in a range of 50 to 100 cp, were supplied under the conditions that the bar diameter was 20 mm, the web tension was in a range of 0 to 2 kg/cm, and the web lap angle was in a range of 0° to 15° so as to obtain the flow rate of 1.0 cc/s/cm. The rotational peripheral speed of the bar 2 was selected to be in a range of 0 to 350 m/min. Under the condition that the damming member was not provided and no fluid supply ports were provided between the dam and the support member, the bead 16 formed between the bar and the web was disturbed so that a stripe-shaped disturbance was generated in the coated surface which should be uniform when the rotational peripheral speed of the bar was not lower than 200 m/min. According to the present invention in which the damming member 19 was provided and the fluid supply ports 20 are also provided, however, the gap between the bar and the support member was filled with the fluid in the widthwise direction at any speed, so that no air was dragged, the bead formed between the bar and the web was stable, and an excellent coated surface was obtained.

In the method and apparatus stated according to the present invention, the bar or roller is floated from the support member uniformly in the widthwise direction so as not to contact with the support member at all; so that no friction is generated between the bar or roller and the support member to generate no cohesion matter in the dispersion fluid. As a result, stable coating having no disturbance in the coated surface could be performed. Further, in the low viscosity region where stable coating could not be performed conventionally, stable coating having no disturbance in the coated surface state could be performed even under the conditions that the coating liquid has relatively high viscosity, the flow rate of the coating liquid is low, and the rotational peripheral speed of the bar is high, because the gap between the bar and the support member is filled with the fluid and no disturbance of the bead is generated. That is, the range of the condition where stable coating could be performed could be expanded.

It should also be understood that the foregoing relates to only a preferred embodiment of the invention, and that it is intended to cover all changes and modifications of the examples of the invention herein chosen for the purposes of the disclosure, which do not constitute departures from the spirit and scope of the invention.

What is claimed is:

1. A coating method of applying coating liquid onto a continuously moving web by a rotating member contacting with the web and a support member rotatably supporting the rotating member, comprising the steps of:

forming a cavity within said support member filled with a supply of the coating liquid, the coating liquid in said cavity and having a uniform, static pressure;

forming a liquid reservoir, which communicates with said cavity via a slit disposed below said rotating member, the liquid reservoir being disposed between the rotating member and the support member;

supplying the coating liquid from said slit to the liquid reservoir uniformly in a widthwise direction of coating such that said static pressure of said cavity is converted to a whole pressure including a dynamic fluid pressure in the liquid reservoir, and the rotating member is supported by said fluid pressure of the liquid reservoir;

forming a bead of the coating liquid by rotating the rotating member in the liquid reservoir, such that the bead thus formed is disposed adjacent to and between the moving web and the rotating member; and applying the bead to the moving web by rotation of the rotating member.

2. The coating method of claim 1, wherein a first liquid reservoir and a second liquid reservoir are formed in each of upstream and downstream sides of the support member in a moving direction of the web, and wherein a clearance is formed between the rotating member and the support member and forms the only communication between the first liquid reservoir and the second liquid reservoir.

3. A coating method of applying coating liquid onto a continuously moving web by a rotating member contacting with the web and a support member rotatably supporting the rotating member, comprising the steps of:

forming a cavity within said support member filled with a supply of the coating liquid;

forming a liquid reservoir, which communicates with said cavity via a slit, the liquid reservoir being disposed between the rotating member and the support member;

supplying the coating liquid from said cavity to the liquid reservoir such that the rotating member is supported by a fluid pressure of the liquid reservoir;

forming a bead of the coating liquid by rotating the rotating member in the liquid reservoir, such that the bead thus formed is disposed adjacent to and between the moving web and the rotating member; and applying the bead to the moving web by rotation of the rotating member;

wherein a first liquid reservoir and a second liquid reservoir are formed in each of upstream and downstream sides of the support member in a moving direction of the web, and wherein a clearance is formed between the rotating member and the support member and forms the only communication between the first liquid reservoir and the second liquid reservoir.

4. The coating method of claim 3, wherein the bead is maintained uniform in a widthwise direction, and the clearance formed between the rotating member and the support member is maintained at a set predetermined distance, such that a stable coating of the coating liquid is applied to the moving web.

5. The coating method of claim 3, wherein a fluid supply port is provided to supply the second liquid reservoir with the coating liquid.

6. A coating apparatus for applying coating liquid onto a continuously moving web, comprising:

a rotating member rotatable and contacting with the moving web; and a support member rotatably supporting the rotating member and comprising:

a fluid supply pipe for supplying the coating liquid to the support member, a cavity formed within said support member and connected to the fluid supply pipe, said cavity being filled with a supply of the coating liquid having a uniform, static pressure, and a liquid reservoir formed between the rotating member and the support member, and, communicating with the cavity by a slit disposed below said rotating member, said slit supplying said coating liquid uniformly in a widthwise direction of coating such that said static pressure of said cavity is converted to a whole pressure including a dynamic fluid pressure in the liquid reservoir, wherein the rotating member is supported by said fluid pressure of the liquid reservoir, and the coating liquid supplied from the liquid reservoir forms a bead of the coating liquid by rotating the rotating member in the liquid reservoir such that the bead thus formed is disposed adjacent to and between the moving web and the rotating member.

7. The coating apparatus of claim 6, wherein the support member includes a first liquid reservoir connected to the slit and a second liquid reservoir in each of upstream and downstream sides of the support member in a moving direction of the web, and wherein a clearance is formed between the rotating member and the support member and forms the only communication between the first liquid reservoir and the second liquid reservoir.

8. The coating apparatus of claim 6, wherein the rotating member has a diameter ranging from 2 to 200 mm.

9. The coating apparatus of claim 6, wherein the support member includes a plurality of slits which are symmetrical with respect to the rotating member.

10. The coating apparatus of claim 6, wherein the rotating member is one of a bar and a roller.

11. A coating apparatus for applying coating liquid onto a continuously moving web, comprising:

a rotating member rotatable and contacting with the moving web; and a support member rotatably supporting the rotating member and comprising:

a fluid supply pipe for supplying the coating liquid to the support member, a cavity formed within said support member and connected to the fluid supply pipe, said cavity being filled with a supply of the coating liquid and a liquid reservoir formed between the rotating member and the support member, and, communicating with the cavity by a slit, wherein the rotating member is supported by a fluid pressure of the liquid reservoir, and the coating liquid supplied from the liquid reservoir forms a bead of the coating liquid by rotating the rotating member in the liquid reservoir such that the bead thus formed is disposed adjacent to and between the moving web and the rotating member; and wherein the support member includes a first liquid reservoir connected to the slit and a second liquid reservoir in each of upstream and downstream sides of the support member in a moving direction of the web, and wherein a clearance is formed between the rotating member and the support member and forms the only communication between the first liquid reservoir and the second liquid reservoir.

12. The coating apparatus of claim 11, wherein the second liquid reservoir is disposed only at a top end of said support member.

13. The coating apparatus of claim 11, wherein the second liquid reservoir is formed by attaching damming walls outside outer walls of said support member at a top end of said support member.

14. The coating apparatus of claim 11, further comprising at least one supply port supplying the coating liquid to the second liquid reservoir.

* * * * *